US010954098B2

(12) United States Patent
Diepolder et al.

(10) Patent No.: US 10,954,098 B2
(45) Date of Patent: Mar. 23, 2021

(54) YARN DELIVERY DEVICE FOR A TWISTING OR CABLING MACHINE

(71) Applicant: Saurer Technologies GmbH & Co. KG, Krefeld (DE)

(72) Inventors: Michael Diepolder, Kempten (DE); Magnus Hiepp, Kempten (DE); Marina Laux, Eggenthal (DE); Walter Pede-Vogler, Durach (DE)

(73) Assignee: Saurer Technologies GmbH & Co. KG, Krefeld (DE)

( * ) Notice: Subject to any disclaimer, the term of this patent is extended or adjusted under 35 U.S.C. 154(b) by 74 days.

(21) Appl. No.: 16/503,705

(22) Filed: Jul. 5, 2019

(65) Prior Publication Data

US 2020/0010300 A1 Jan. 9, 2020

(30) Foreign Application Priority Data

Jul. 9, 2018 (DE) ..... 10 2018 005 392.0

(51) Int. Cl.

| | |
|---|---|
| ***B65H 59/00*** | (2006.01) |
| ***B65H 51/08*** | (2006.01) |
| ***D01H 5/00*** | (2006.01) |
| *B65H 57/14* | (2006.01) |
| *D07B 7/16* | (2006.01) |

(52) U.S. Cl.

CPC ..... *B65H 59/005* (2013.01); *B65H 51/08* (2013.01); *D01H 5/005* (2013.01); *B65H 57/14* (2013.01); *D07B 7/16* (2013.01)

(58) Field of Classification Search

CPC ..... D01H 5/005; D07B 7/16; B65H 51/08; B65H 57/14; B65H 59/005

USPC ..... 57/90, 91

See application file for complete search history.

(56) References Cited

U.S. PATENT DOCUMENTS 3,025,660 A * 3/1962 Gonsalves ..... D02J 1/225 57/309
3,152,769 A * 10/1964 Dzugan ..... B65H 54/28 242/483.3
3,425,106 A * 2/1969 Mattingly ..... D02G 1/127 28/221

(Continued)

FOREIGN PATENT DOCUMENTS

DE 19924595 C1 * 9/2000 ..... B65H 63/04

*Primary Examiner* — Shaun R Hurley

(74) *Attorney, Agent, or Firm* — Nelson Mullins Riley & Scarborough LLP

(57) ABSTRACT

Yarn delivery device for a twisting or cabling machine having a first deflection roller for deflecting a yarn; a driven godet, arranged downstream of first deflection roller in yarn transport direction; a separator roller, arranged relative to the godet such that a yarn can be laid several times around the separator roller and the godet, said yarn being wrapped around separator roller and godet jointly; and a pitch lever, having a second deflection roller arranged downstream of godet in the yarn transport direction, for deflecting the yarn again. A cantilever, having a third deflection roller, which, in the yarn transport direction, is arranged downstream of second deflection roller and upstream of traversing yarn guide for feeding the yarn onto a take-up package, second deflection roller being arranged on a different side of a vertical plane extending through axis of rotation of the separator roller from the third deflection.

8 Claims, 3 Drawing Sheets

(56) References Cited

U.S. PATENT DOCUMENTS

| | | | | | |
|---|---|---|---|---|---|
| 4,087,056 | A * | 5/1978 | Wilding | B65H 54/28 | 242/483.5 |
| 4,107,912 | A * | 8/1978 | Pockman | D07B 3/085 | 226/190 |
| 4,130,249 | A * | 12/1978 | Steinhilber | B65H 54/32 | 242/480.7 |
| 4,327,873 | A * | 5/1982 | Juppet | B65H 59/385 | 226/24 |
| 4,829,757 | A * | 5/1989 | Canton | D02J 1/08 | 57/6 |
| 6,375,112 | B1 * | 4/2002 | Engelhardt | B65H 59/005 | 242/417 |
| 2006/0261206 | A1 * | 11/2006 | Schmalholz | B65H 54/36 | 242/413.5 |
| 2009/0152388 | A1 * | 6/2009 | Hinc | B65H 51/20 | 242/155 R |
| 2018/0037433 | A1 * | 2/2018 | Grossman | B65H 59/387 | |

* cited by examiner

YARN DELIVERY DEVICE FOR A TWISTING OR CABLING MACHINE

CROSS-REFERENCE TO RELATED APPLICATIONS

This application claims priority from German National Patent Application No. 10 2018 005 392.0, filed Jul. 9, 2018, entitled "Fadenliefervorrichtung für eine Zwim-oder Kabliermaschine", the entire contents of which are incorporated herein by reference.

FIELD OF THE INVENTION

The invention relates to a yarn delivery device for a twisting or cabling machine, a workstation of a twisting or cabling machine comprising such a yarn delivery device, and a twisting or cabling machine comprising such a workstation.

BACKGROUND OF THE INVENTION

German Patent Publication DE 199 24 595 C1 discloses a twisting machine on which the twisted yarn is guided via a deflection roller to a delivery device, which comprises a godet and a separator roller. The twist is guided with several wraps around the godet and the separator roller and runs from the godet to a deflection roller, which is arranged at the free end of a pitch lever and has a horizontal axis of rotation. In a front view, the free end of the pitch lever is located in front of the delivery device, while the other end of the pitch lever is mounted below the delivery device at a mounting, fixedly with respect to the frame, on a carrier plate in such a way that the pitch lever can be pivoted about a horizontal axis. After the deflection roller arranged on the pitch lever, the twist runs via a traversing yarn guide known per se to a winding package. The traversing yarn guide performs an oscillating movement along the surface of the winding package and parallel to the axis of the winding package, and this leads to uniform winding of the twist on the winding package. The pitch lever is used for length compensation. Because of the pendular movements of the pitch lever, the angle of inclination of the yarn entering the traversing yarn guide differs in accordance with the maximum angular positions of the pitch lever. This results in different states in the region of the run-on point of the yarn onto the winding package. In order to exchange the feed package located under the mounting for the pitch lever, the pitch lever can be pivoted to one side about a vertical axis in a twisting machine according to German Patent Publication DE 199 24 595 C1. At least one sensor detects both the pivoting of the pitch lever about the horizontal axis and the pivoting about the vertical axis and generates a signal when a defined limit value of the pivoting is exceeded.

SUMMARY OF THE INVENTION

The expressions "yarn" and "thread" may be used interchangeably in the context of the present invention.

A first embodiment of the invention therefore relates to a yarn delivery device for a twisting or cabling machine, for feeding a yarn via a traversing yarn guide onto a take-up package, the yarn delivery device comprising: a first deflection roller for deflecting a yarn; a driven godet which is arranged downstream of the first deflection roller in the yarn transport direction; a separator roller, which is arranged relative to the godet in such a way that a yarn can be laid several times around the separator roller and the godet, said yarn being wrapped around the separator roller and the godet jointly; and a pitch lever, which has a second deflection roller arranged downstream of the godet in the yarn transport direction, for deflecting the yarn again.

The proposed yarn delivery device is distinguished by a cantilever with a third deflection roller, which, in the yarn transport direction, is arranged downstream of the second deflection roller and upstream of the traversing yarn guide for feeding the yarn onto a take-up package, the second deflection roller being arranged on a different side of a vertical plane extending through the axis of rotation of the separator roller from the third deflection roller in order to receive the yarn from the separator roller or the godet and to deflect the yarn toward the third deflection roller.

Because in a front view the pitch lever is arranged behind the godet and not, as before, in front of the yarn delivery device, the available free space around the yarn delivery device is enlarged. According to the invention, because of the enlarged free space under the yarn delivery device, it is no longer necessary to pivot a pitch lever to the side in order to replace an empty feed package with a new, full feed package, and therefore the loading of the spindle is simplified. The loading advantage applies particularly in the case of small gauges.

Additionally, the situation in which the pitch lever is not completely pivoted back into its predefined place after the feed package has been exchanged, which situation constitutes a source of error, is eliminated.

Because the twisted yarn is fed via the second deflection roller of the pitch lever to a stationary, horizontally mounted third deflection roller and from the third deflection roller to the traversing yarn guide, the entry angle of the yarn into the traversing yarn guide is defined and constant during the entire process. In the previous arrangement, in which the yarn was transferred from the pitch lever arranged in front of the yarn delivery device into the traversing yarn guide, the necessary pendular movement of the pitch lever caused the angle of inclination of the yarn entering the traversing yarn guide to differ in accordance with the angular positions of the pitch lever. These variations in the angle of inclination resulted in different states in the region of the run-on point of the yarn on the take-up package. Because of the design of the yarn delivery device according to the invention, with the third deflection roller, which is arranged in a stationary manner on a cantilever, a constant and exact last deflection point of the yarn before the entry into the traversing yarn guide is always ensured, and therefore the angle of inclination at which the yarn enters the traversing yarn guide is likewise constant. This has a positive effect on the quality of the cabling packages.

Tension fluctuations caused by the traversing yarn guide, which moves back and forth, are absorbed by means of the pitch lever. Previously, if the traversing yarn guide was in the center position thereof, the distance of the traversing yarn guide from the deflection roller of the pitch lever was shorter than in the two reversal positions. By up and down movements or the pivoting movements of the pitch lever, these length differences were compensated and thus a more uniform yarn tension was enabled. The yarn delivery device according to the invention eases this direct yarn tension equalization at the traversing triangle, because the yarn is fed from the pitch lever via a stationary third deflection roller to the traversing yarn guide.

As before, the yarn can be guided either from the godet to the second deflection roller of the pitch lever or from the non-driven separator roller to the pitch lever. In tests, it was found that the yarn tension equalization is further optimized by the transfer of the yarn from the passive separator roller, because a considerably greater equalization path is used.

In an advantageous design, the pitch lever and/or the cantilever is arranged on a housing of the yarn delivery device.

By integrating the pitch lever and/or all yarn deflections into the assembly of the yarn delivery device, a compact assembly enabling simpler handling for the operating personnel is achieved. Furthermore, older twisting and cabling machines already in use can also be retrofitted with such a component.

In particular, the second deflection roller and the third deflection roller are arranged on the same side of a horizontal plane extending through the axis of rotation of the separator roller.

This arrangement of the pitch lever makes it possible to further enlarge or optimize the working area for the operating personnel.

In another preferred design of the yarn delivery device, the free end of the pitch lever, on which free end the second deflection roller is mounted, is arranged above the godet in the region of the yarn delivery device.

This arrangement of the pitch lever makes it possible to enlarge the working area for the operating personnel to the maximum extent.

Alternatively, the second deflection roller is arranged on a different side of a horizontal plane extending through the axis of rotation of the separator roller from the third deflection roller.

Such an arrangement not only allows the working area above the spindle to be enlarged but also enables good accessibility of the pitch lever.

In another advantageous design of the invention, the free end of the pitch lever, on which free end the second deflection roller is mounted, protrudes below the yarn delivery device.

Such an arrangement is particularly advantageous and ensures ample free space for exchanging the feed package and easy accessibility of the pitch lever for the case that the yarn must be manually guided over the second deflection roller.

A second embodiment of the invention therefore relates to a workstation of a twisting or cabling machine, for winding a yarn via a traversing yarn guide onto a take-up package, the workstation having a yarn delivery device, which comprises: a first deflection roller for deflecting a yarn; a driven godet, which is arranged downstream of the first deflection roller in the yarn transport direction; a separator roller, which is arranged relative to the godet in such a way that a yarn can be laid several times around the separator roller and the godet, said yarn being wrapped around the separator roller and the godet jointly; and a pitch lever, which has a second deflection roller arranged downstream of the godet in the yarn transport direction, for deflecting the yarn again.

The workstation is distinguished in that the yarn delivery device is formed by a yarn delivery device according to one of the embodiments described above.

If the workstation is equipped with a yarn delivery device designed in such a way, this has a positive effect on the quality of the cabling packages and makes the handling easier for the operating personnel.

Because of the stationary arrangement of the third deflection roller on the yarn delivery device, a defined entry angle or angle of inclination of the yarn into the traversing yarn guide is continuously ensured. The pitch lever still absorbs the tension fluctuations caused by the oscillating traversing yarn guide, but without itself causing fluctuating angles of inclination of the yarn entering the traversing yarn guide because of the pendular movements.

At the same time, the free space or rather the accessibility of the workstation is optimized by the compact design. The feed package mounted on the spindle can be more easily and more quickly replaced with a new feed package, because the pitch lever no longer has to be pivoted away to the side for the loading process. The pitch lever does not interfere with the working area in which the feed packages are manually removed from the spindle and mounted onto the spindle, while previously the pitch lever would still protrude into the working area even when the pitch lever was pivoted to the side.

A third aspect of the invention therefore relates to a twisting or cabling machine having a plurality of workstations for winding a yarn via a traversing yarn guide onto a take-up package, the workstations having a yarn delivery device, which comprises: a first deflection roller for deflecting a yarn; a driven godet, which is arranged downstream of the first deflection roller in the yarn transport direction; a separator roller, which is arranged relative to the godet in such a way that a yarn can be laid several times around the separator roller and the godet, said yarn being wrapped around the separator roller and the godet jointly; and a pitch lever, which has a second deflection roller arranged downstream of the godet in the yarn transport direction, for deflecting the yarn again.

The twisting or cabling machine is distinguished in that at least one workstation is formed by a workstation according to the embodiment described above.

Overall, the machine operation is made easier for the personnel in the case of a twisting or cabling machine designed in such a way, and this also has a positive effect on the efficiency of the whole twisting or cabling machine. Because one person typically looks after a plurality of machines each having a plurality of workstations, time and effort are saved when there are fewer necessary work steps to be performed.

Furthermore, because the pitch lever no longer protrudes into or can be pivoted into the working area, sources of errors resulting from improper positioning of the pitch lever when the pitch lever is pivoted out of or into the working area are reduced.

Such a twisting and cabling machine can also produce a twist or a cabling package having optimized quality, because the constant angle of inclination of the yarn as the yarn enters the traversing yarn guide has a positive effect.

BRIEF DESCRIPTION OF THE DRAWINGS

Further features and advantages of the invention are evident from the following description of preferred embodiment examples of the invention, on the basis of the figures and drawings illustrating details essential to the invention, and from the claims. The individual features can be implemented individually or in any desired combination in a preferred embodiment of the invention.

Preferred embodiment examples of the invention are explained in more detail below on the basis of the enclosed drawings.

DESCRIPTION OF THE PREFERRED EMBODIMENTS

The following description of the embodiments of the present invention is merely exemplary in nature and is in no way intended to limit the invention, its application, or uses. The following description is provided herein solely by way of example for purposes of providing an enabling disclosure of the invention, but does not limit the scope or substance of the invention.

Figure 1:
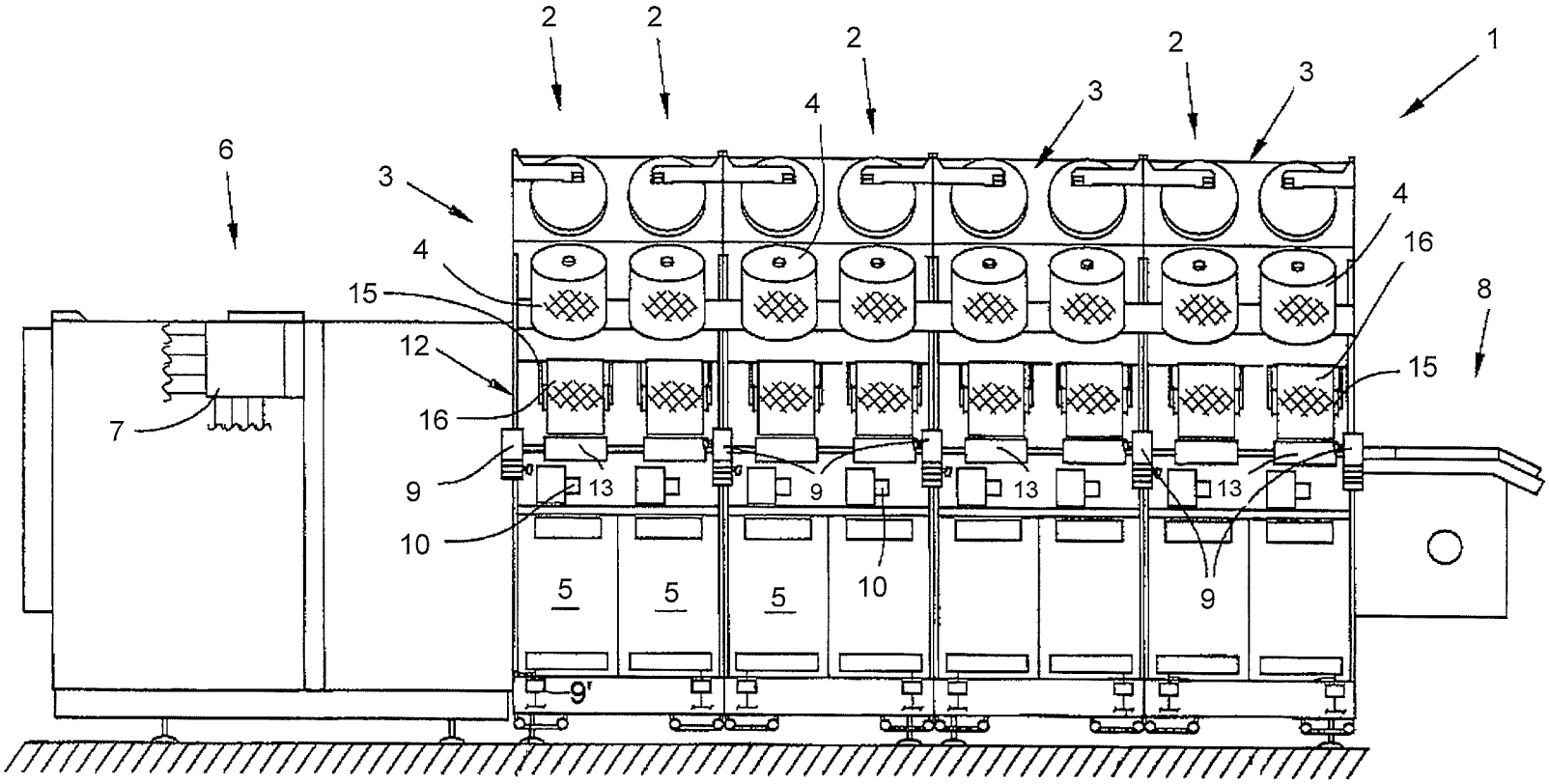
FIG. 1 shows a front view of a twisting or cabling machine, the workstations of which are equipped with the yarn delivery devices according to the invention.

FIG. 1 shows a front view of a twisting or cabling machine 1. Such textile machines each have a plurality of identical workstations 2 in the region of the machine longitudinal sides of such textile machines.

Such textile machines also generally have a drive and operating unit 6 arranged at a machine end, in which drive and operating unit 6 for example the necessary energy apparatuses, various drives and a central control device 7 are installed.

In the embodiment example, the twisting or cabling machine 1 also has a package transport system, the schematically illustrated delivery point of which is labelled with reference number 8.

As is known, the workstations 2 of twisting or cabling machines 1 with outer yarn feeding each have a creel 3, which serves to hold at least one first feed package 4, from which what is referred to as an outer yarn is drawn.

Such workstations 2 also each have a cabling spindle driven by a spindle drive (for better clarity, this is not shown in greater detail in the figures of the present application). Such a spindle drive can be a motor that directly drives the cabling spindle or can be an indirect drive, for example a belt drive.

As usual, the cabling spindle, which in the embodiment example of FIG. 1 is arranged behind a movably mounted protection wall 5, additionally bears, on a stationary spindle pot bottom arranged on the cabling spindle, a second feed package, from which what is referred to as an inner yarn is drawn off from above, which inner yarn is fed above the cabling spindle to a cord regulator or balloon yarn guide (not shown).

The outer yarn is drawn from the first feed package 4, which is stored in the creel 3, and is first fed to a yarn-tension influencing device 9, by means of which the yarn tension of the outer yarn can be varied or set.

The outer yarn subsequently circles around the cabling spindle, a free yarn balloon thus being formed. The cord regulator or balloon yarn guide, in which the outer yarn drawn from the first feed package 4 and the inner yarn drawn from the second feed package are brought together, determines the height of the free yarn balloon that is formed. The cabling point, at which the outer yarn and the inner yarn merge, is located in this apparatus, which also referred to as a balancing system.

The yarn delivery device 10, by means of which the twisted or cabled yarn is drawn off and fed via a pitch lever 11 to a winding device 12, is arranged above the cabling point.

As usual, the winding device 12 has a drive roller 13 and a traversing yarn guide 14. By means of the traversing yarn guide 14, the yarn is wound onto a take-up package 16, which is frictionally driven by the drive roller 13 and is held in a package cradle 15.

Figure 2:
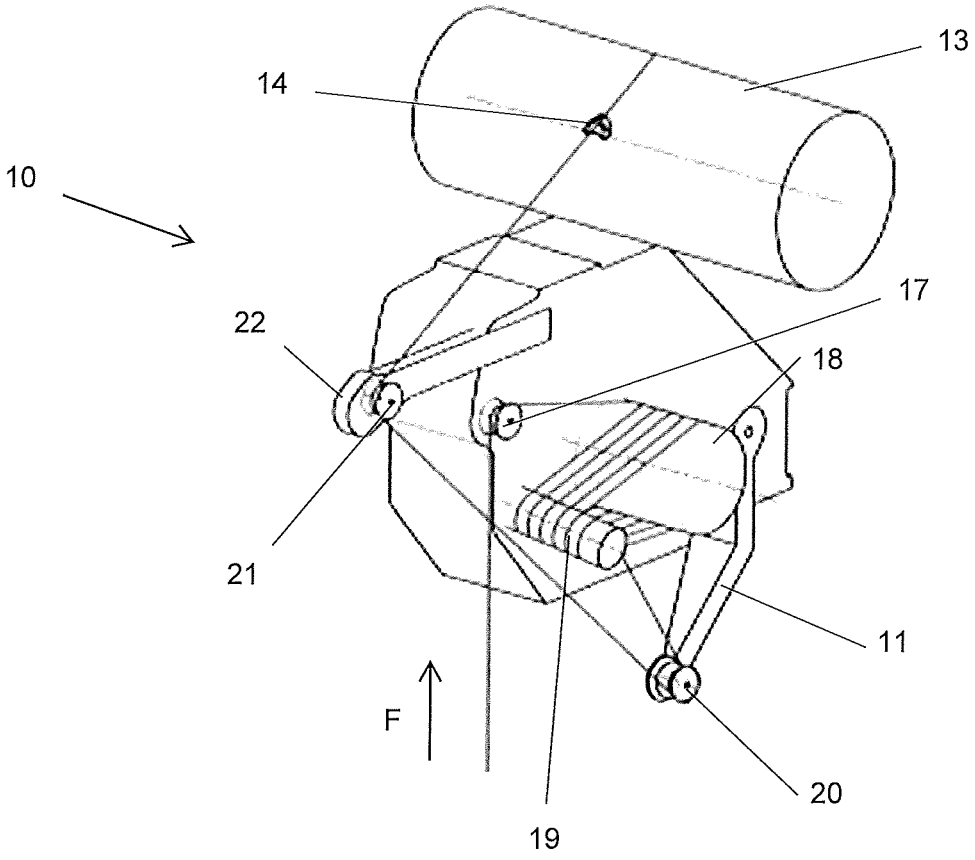
FIG. 2 shows a view of an embodiment of the yarn delivery device according to the invention with the yarn path shown.

FIG. 2 schematically shows an embodiment of the yarn delivery device 10 according to the invention in which the second deflection roller 20 and the third deflection roller 21 are arranged on different sides of a horizontal plane extending through the axis of rotation of the separator roller 19. The yarn, coming from below in the yarn running direction F, runs across the rotatably mounted first deflection roller 17, is deflected approximately by 90° and runs onto the godet 18. The yarn is guided around the godet 18 and the separator roller 19 in several turns in order subsequently to be guided from the separator roller 19 via the second deflection roller 20, which is rotatably mounted at the free end of the pitch lever 11, which is arranged behind the godet 18, to a third deflection roller 21. The third deflection roller 21 is rotatably mounted on a cantilever 22, which is arranged on the yarn delivery device 10 so as to lie in front of the yarn delivery device 10. From the third deflection roller 21, the yarn runs at a defined and constant angle of inclination into the traversing yarn guide 14, which winds the yarn onto the take-up package 16 with oscillating movements.

Figure 3:
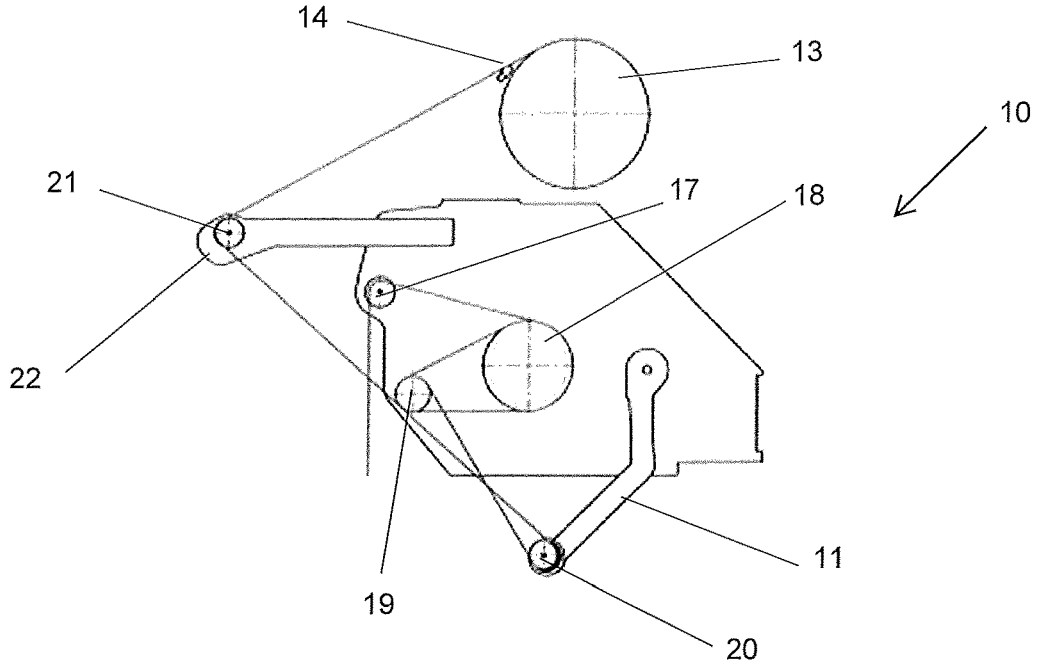
FIG. 3 shows a side view of the embodiment of the yarn delivery device according to the invention shown in FIG. 2, with an alternative yarn path.

FIG. 3 shows the same embodiment as FIG. 2 in a side view, only one part of the yarn path being different. Likewise in this variant, the yarn is fed across the first deflection roller 17, several times across the godet 18 and the separator roller 19, and from the separator roller 19 to the pitch lever 11 or rather to the second deflection roller 20 arranged on the pitch lever 11. However, the yarn is guided around the second deflection roller 20 from the front, and not from the rear as shown in FIG. 2, to the third deflection roller 21, the yarn path thus having a crossing point in the side view.

Figure 4:
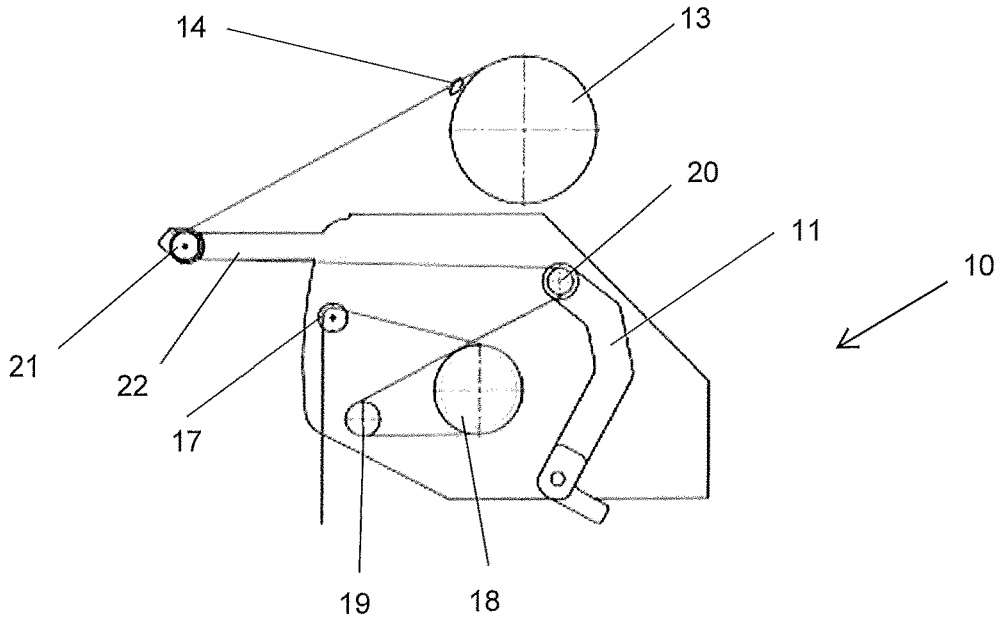
FIG. 4 shows a view of a further embodiment of the yarn delivery device according to the invention with the yarn path shown.

FIG. 4 shows a side view of an alternative embodiment of the yarn delivery device 10 according to the invention. In the installed state of the yarn delivery device 10, the pitch lever 11 is arranged behind the godet 18, but the free end of the pitch lever 11 on which the second deflection roller 20 is mounted is arranged upward toward the take-up package 16. This means that the second deflection roller 20 and the third deflection roller 21 are arranged on the same side of a horizontal axis extending through the axis of rotation of the separator roller 19. Via the first deflection roller 17, the yarn is guided several times around the driven godet 18 and the passive separator roller 19, in order to be fed from the separator roller 19 via the second deflection roller 20 and further via the third deflection roller 21 to the traversing yarn guide 14.

LIST OF REFERENCE NUMBERS

1 Twisting or cabling machine
2 Workstations
3 Creel
4 First feed package
5 Protection wall
6 Drive and operating unit
7 Control device
8 Package transport system
9 Yarn-tension influencing device
10 Yarn delivery device
11 Pitch lever
12 Winding device
13 Drive roller
14 Traversing yarn guide
15 Package cradle
16 Take-up package

17 First deflection roller
18 Godet
19 Separator roller
20 Second deflection roller
21 Third deflection roller
22 Cantilever It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A yarn delivery device for a twisting or cabling machine, for feeding a yarn via a traversing yarn guide to a take-up package, the yarn delivery device comprising:

a first deflection roller for deflecting a yarn, a driven godet, which is arranged downstream of the first deflection roller in the yarn transport direction, a separator roller, which is arranged relative to the godet in such a way that a yarn can be laid several times around the separator roller and the godet, said yarn being wrapped around the separator roller and the godet jointly, and a pitch lever, which has a second deflection roller arranged downstream of the godet in the yarn transport direction, for deflecting the yarn again, characterised by a cantilever, which has a third deflection roller, which, in the yarn transport direction, is arranged downstream of the second deflection roller and upstream of the traversing yarn guide for feeding the yarn onto a take-up package, the second deflection roller being arranged on a different side of a vertical plane extending through the axis of rotation of the separator roller than the third deflection roller in order to receive the yarn from the separator roller or the godet and to deflect the yarn toward the third deflection roller.

2. The yarn delivery device according to claim 1, characterised in that the pitch lever, the cantilever, or a combination thereof is arranged on a housing of the yarn delivery device.

3. The yarn delivery device according to claim 1, characterised in that the second deflection roller and the third deflection roller are arranged on the same side of a horizontal plane extending through the axis of rotation of the separator roller.

4. The yarn delivery device according to claim 3, characterised in that the free end of the pitch lever, on which free end the second deflection roller is mounted, is arranged above the godet in the region of the yarn delivery device.

5. The yarn delivery device according to claim 1, characterised in that the second deflection roller is arranged on a different side of a horizontal plane extending through the axis of rotation of the separator roller from the third deflection roller.

6. The yarn delivery device according to claim 5, characterised in that the free end of the pitch lever, on which free end the second deflection roller is mounted, protrudes below the yarn delivery device.

7. A workstation of a twisting or cabling machine, for winding a yarn via a traversing yarn guide onto a take-up package, the workstation having a yarn delivery device, which comprises a first deflection roller for deflecting a yarn, a driven godet, which is arranged downstream of the first deflection roller in the yarn transport direction, a separator roller, which is arranged relative to the godet in such a way that a yarn can be laid several times around the separator roller and the godet, said yarn being wrapped around the separator roller and the godet jointly, and a pitch lever, which has a second deflection roller arranged downstream of the godet in the yarn transport direction, for deflecting the yarn again, characterised in that the yarn delivery device comprises:

a cantilever, which has a third deflection roller, which, in the yarn transport direction, is arranged downstream of the second deflection roller and upstream of the traversing yarn guide for feeding the yarn onto a take-up package, and the second deflection roller being arranged on a different side of a vertical plane extending through the axis of rotation of the separator roller than the third deflection roller in order to receive the yarn from the separator roller or the godet and to deflect the yarn toward the third deflection roller.

8. A twisting or cabling machine having a plurality of workstations for winding a yarn via a traversing yarn guide onto a take-up package, the workstations having a yarn delivery device, which comprises a first deflection roller for deflecting a yarn, a driven godet, which is arranged downstream of the first deflection roller in the yarn transport direction, a separator roller, which is arranged relative to the godet in such a way that a yarn can be laid several times around the separator roller and the godet, said yarn being wrapped around the separator roller and the godet jointly, and a pitch lever, which has a second deflection roller arranged downstream of the godet in the yarn transport direction, for deflecting the yarn again, characterised in that at least one workstation has the yarn delivery device wherein the yarn delivery device comprises:

a cantilever, which has a third deflection roller, which, in the yarn transport direction, is arranged downstream of the second deflection roller and upstream of the traversing yarn guide for feeding the yarn onto a take-up package, and the second deflection roller being arranged on a different side of a vertical plane extending through the axis of rotation of the separator roller than the third deflection roller in order to receive the yarn from the separator roller or the godet and to deflect the yarn toward the third deflection roller.

* * * * *